United States Patent [19]

Fiegen et al.

[11] Patent Number: 4,498,220

[45] Date of Patent: Feb. 12, 1985

[54] METHOD FOR PRE-EXPANDING HEAT EXCHANGER TUBE

[75] Inventors: Donald S. Fiegen, LaCrescent, Minn.; Chester D. Ware, La Crosse, Wis.

[73] Assignee: The Trane Company, La Crosse, Wis.

[21] Appl. No.: 410,724

[22] Filed: Aug. 23, 1982

[51] Int. Cl.[3] ..... B21D 53/02; B23P 25/00

[52] U.S. Cl. ..... 29/157.3 C; 29/421 R; 29/527.4; 29/458; 29/459

[58] Field of Search ..... 29/157.3 C, 421 R, 157.3 V, 29/157.3 A, 458, 459, 527.4; 165/133, 165; 72/62; 148/115 C

[56] References Cited

U.S. PATENT DOCUMENTS

| | | | |
|---|---|---|---|
| 1,870,670 | 8/1932 | Brown | 165/165 |
| 3,882,712 | 5/1975 | Shapiro et al. | 148/11.5 C X |
| 3,979,810 | 9/1976 | Krips et al. | 29/157.4 |
| 4,068,372 | 1/1982 | Kamohara et al. | 29/727 |
| 4,125,937 | 11/1978 | Brown et al. | 29/727 |
| 4,159,564 | 7/1979 | Cooper, Jr. | 29/727 |
| 4,210,991 | 7/1980 | Cooper, Jr. | 29/421 |
| 4,354,550 | 10/1982 | Mondahl et al. | 165/133 |
| 4,418,556 | 12/1983 | Galle et al. | 72/62 |

FOREIGN PATENT DOCUMENTS

| | | | |
|---|---|---|---|
| 2418146 | 11/1975 | Fed. Rep. of Germany | 29/157.3 V |
| 1143758 | 10/1957 | France | 29/157.3 C |
| 2391786 | 1/1979 | France | 72/62 |
| 55-109527 | 8/1980 | Japan | 29/157.3 C |
| 56-26633 | 3/1981 | Japan | 29/157.3 C |
| 146430 | 9/1982 | Japan | 29/152.3 C |
| 186939 | 12/1963 | Sweden | 72/62 |
| 772134 | 4/1957 | United Kingdom | 72/62 |
| 810219 | 5/1957 | United Kingdom | 72/62 |

*Primary Examiner*—Carl E. Hall
*Assistant Examiner*—John T. Burtch
*Attorney, Agent, or Firm*—Ronald M. Anderson; Carl M. Lewis

[57] ABSTRACT

This invention is a method for pre-expanding a heat exchanger tube prior to its insertion into a tube sheet. A tubular mandrel having an elastic bladder sheath sealed at each end is inserted into the tube and positioned at the point where the tube is to be expanded. A die with an annular recess approximating the shape to which the tube is to be expanded is clamped around the outer surface of the tube, concentric to the mandrel. The elastic bladder is then pressurized with hydraulic fluid pumped through a passage in the mandrel, thereby deforming the tube outward so that it conforms to the recess in the die. A heat transfer enhancement treatment thereafter may be applied to the exterior of the tube between the expanded sections, without concern that it may crack off when the tube is installed in a tube sheet. In addition, the hydraulic pre-expansion process prevents or minimizes cracking of the tube which sometimes occurs when a tube is expanded to an equivalent diameter in a single operation.

10 Claims, 8 Drawing Figures

METHOD FOR PRE-EXPANDING HEAT EXCHANGER TUBE

BACKGROUND OF THE INVENTION

1. Technical Field

This invention generally pertains to a method of expanding a tube, and specifically to the pre-expansion of a heat exchanger tube using pressurized fluid.

2. Background Art

During the construction of tube and shell heat exchangers, it is common practice to expand a section of a tube so that it engages a bore within a tube sheet. A variety of mechanical swaging tools are available for this purpose, most involving a mandrel having rollers which may be forced radially outward as the mandrel is turned within the tube bore.

Radial force to deform the tube into contact with the bore of the tube sheet can also be provided by hydraulic fluid. Examples of this approach are disclosed in U.S. Pat. Nos. 3,979,810; 4,125,937; 4,159,564; and 4,210,991. In the U.S. Pat. No. 3,979,810 patent, a mandrel having spaced apart "O" ring seals is inserted into the tube after its installation in a tube sheet, and pressurized fluid is supplied through passages in the mandrel to expand the tube. Roll swagging of a portion of the expanded section subsequently eliminates some of the resulting tensile stress, and eliminates annular crevices at the inner edge of the tube plate bore.

The other three patents noted above disclose related tube expansion mandrels. The U.S. Pat. No. 4,125,937 patent provides for a tapered portion on the mandrel and a helical spring acting in cooperation to ease the mandrel into the tube and seat the "O" ring, once it is in position. In the U.S. Pat. No. 4,159,564 patent, an eddy current coil is used to position the mandrel before the pressurized fluid is applied. A very high pressure pulse is applied to the already pressurized annular space between a tube and a mandrel sealed with "O" rings in the U.S. Pat. No. 4,210,991 patent; this insures that the tube is fully expanded within a tube sheet bore.

None of the prior art addresses the problem of seating a tube in a tube sheet/support after a treatment to enhance heat transfer has been applied to the outer surface of the tube. It is well known that application of sintered metal or a flame sprayed porous coating to the exterior surface of a tube greatly increases its heat transfer capacity by improving nucleate boiling. Such coatings are somewhat fragile, and are likely to crack or break away if adjacent sections of the tube are expanded in a tube sheet/support after the coating is applied. Particulate matter from the coating may later contaminate the heat exchange fluid and the connected system.

The added thickness of a heat transfer enhancement coating increases the diameter of the bores in the tube supports and tube sheets through which the tube is inserted when it is installed. Consequently, the tube must be expanded to a larger diameter to seat within these bores. If roll swaged in a single operation without annealing, the tube may crack as a result of work hardening. Expansion of a tube to the relatively larger diameter required for a tube that is coated compared to one that is not greatly increases the risk that such cracking may occur.

It is therefore an object of this invention to provide a method for pre-expanding heat exchanger tubing, prior to its installation in a tube sheet/support.

A still further object of this invention is to pre-expand selected sections of tubing prior to the application of a heat transfer coating to avoid cracking or breaking away of the coating after the tube is installed in a tube sheet.

Yet a still further object of this invention is to avoid cracking of the tube when it is installed in a tube sheet/-support.

These and other objects of the invention will be apparent from the description of the preferred embodiment which follows hereinbelow and from the drawings.

DISCLOSURE OF THE INVENTION

The invention is a method of pre-expanding selected sections of a heat exchanger tube prior to its installation in a tube sheet, or tube support so that the selected sections are expanded to a diameter than is approximately equal or greater than the expected overall diameter of those portions of the tube, between the expanded sections, to which a nucleate boiling heat transfer enhancement treatment is to be applied. In the method, a mandrel having an elongate elastic bladder concentrically disposed about it and sealed at each end is inserted into the bore of the tube. The mandrel and elastic bladder are positioned inside one of the selected sections to be expanded, and a die having an internal annular recess approximating the expanded dimensions of the tube is positioned so that it concentrically encloses the section to be expanded.

A fluid under pressure is pumped through a passage in the mandrel to expand the elastic bladder so that it deforms the heat exchanger tube outward into the annular recess of the die. Nucleate boiling heat transfer enhancement treatment is applied to the tube on that portion not expanded, and the expanded section is inserted into a tube sheet or tube support. The expanded section is mechanically swaged radially outward so that the tube is in intimate contact with the inner surface of the tube sheet or tube support bore.

DESCRIPTION OF THE PREFERRED EMBODIMENT

Figure 1:
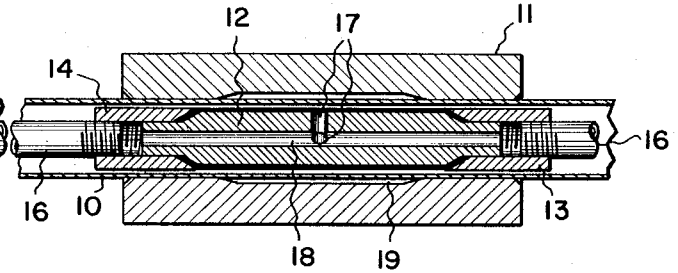
FIG. 1 shows a cutaway view of an intermediate section of a tube to be expanded, a mandrel, and a die, with these components positioned on a section of the tube prior to its expansion according to the subject invention.

With reference to FIGS. 1–4 and FIGS. 6 and 7, apparatus for expanding a tube according to the method of the subject invention are shown in detail. In FIG. 1, an intermediate section of tube 10 has a steel split clamp 11 concentrically applied to its exterior surface. Clamp 11 is centered about the longitudinal axis of steel mandrel 12 which is positioned inside the bore of tube 10 at the point where the tube is to be expanded and serves as a die, as explained below.

Mandrel 12 comprises a cylinder several inches in length having a diameter approximately 1/10 of an inch less than the internal diameter of tube 10. Mandrel 12 is necked down to a smaller diameter at each end, and external threads are formed on the smaller diameter portion. End caps 13 and 14 are threaded onto the necked-down ends of mandrel 12 and are tightened sufficiently to clamp an elastic bladder 15 in place around mandrel 12 at the beveled angle where it is necked down. In the preferred embodiment elastic bladder 15 is made from a neoprene rubber sheath having an undeformed wall thickness of about 1/16 of an inch. The ends of the elastic bladder 15 are clamped and hermetically sealed between matching beveled portions of mandrel 12 and end caps 13 and 14.

Hydraulic fluid lines 16 are threaded into each end cap 13 and 14, and extend along the bore of tube 10 to similar mandrel and clamp assemblies (not shown), to provide the means for simultaneously expanding a plurality of sections along the axial length of tube 10. At one end of a series of such assemblies, tube 16 is connected to a suitable hydraulic pump (also not shown), and at the other end of such a series of assemblies, a suitable plug may be threaded into one of the end caps 13 or 14 to seal the system. Thus, a single source of hydraulic pressure can be used to simultaneously expand a plurality of sections along the axial length of tube 10.

Figure 2:
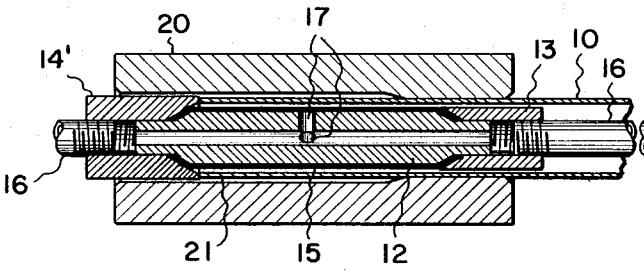
FIG. 2 shows a cutaway view of an end section of a tube to be expanded, a mandrel, and a die, with these components positioned adjacent the end of the tube prior to its expansion.

During the expansion process, hydraulic fluid is applied under pressure through a bore 18 extending through the longitudinal axis of mandrel 12. Hydraulic fluid under pressure passes through a plurality of passages 17 which extend from bore 18 to the external surface of mandrel 12, at a point midway along its length. The hydraulic fluid pumped through passages 17 forces the elastic bladder 15 outward causing tube 10 to deform into an annular expansion cavity, or die 19, formed on the internal surface of split clamps 11. Cavity 19 is disposed around the internal circumference of split clamps 11, has an internal diameter substantially equal to the desired external diameter of the expanded tube section, and has approximately a 5° bevel at each end. In FIG. 2, a split clamp 20 is used in expanding the section of tube 10 adjacent one end. Split clamp 20 differs from split clamp 11 by the shape of its expansion cavity 21. Expansion cavity 21 has a 5° bevel on one end, but the other end is not beveled and extends with a constant diameter well beyond the beveled portion of mandrel 12. A larger diameter end cap 14' is also used with split clamp 20. Although FIG. 2 shows a hydraulic tube 16 threaded into end cap 14', a plug may instead be threaded into end cap 14', to seal the system, as noted above.

Figure 3:
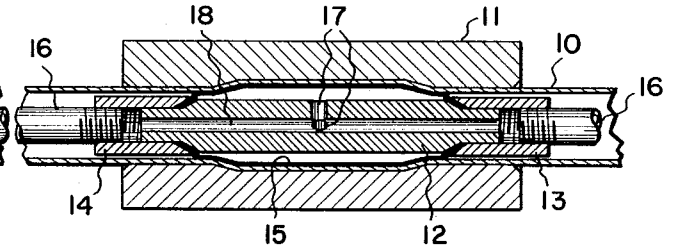
FIG. 3 shows an analogous view of the tube to that shown in FIG. 1, after the tube has been expanded.
Figure 4:
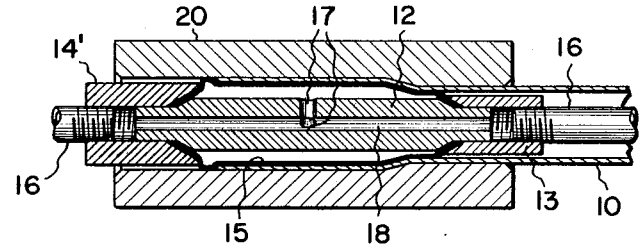
FIG. 4 shows an analogous view of the tube to that shown in FIG. 2, after the tube has been expanded.

In FIGS. 3 and 4, pressurized hydraulic fluid has been applied through hydraulic line 16 to expand the elastic bladder 15 and thereby deform the surrounding tube 10. The result is shown for both intermediate split clamps 11 and end split clamps 20, respectively. The hydraulic fluid applied through hydraulic lines 16, bore 18, and orifices 17, causes the elastic bladder 15 to expand outwardly into close contact with the heat exchanger tube 10. At about 3000 PSI, a thin wall copper tube 10 begins to deform into the expansion cavity 19, or 21; and at about 4000 PSI, such a tube 10 is "set" in its pre-expanded shape.

End cap 14' is sized larger in diameter than end cap 14 to prevent the elastic bladder 15 from tearing on its relatively sharp beveled end, when the bladder is expanded with hydraulic fluid. The expansion cavities 19 and 21 must be relatively smooth and all parts impinging into the elastic bladder 15 must be free of sharp edges to avoid wear and puncture. Since the elastic bladder 15 is contained in all directions, it is not subject to rupture, even though sufficient pressure is applied through the hydraulic fluid to cause the tube 10 to yield beyond its elastic limit and to conform to the shape of the expansion cavities 19 or 21.

Figure 7:
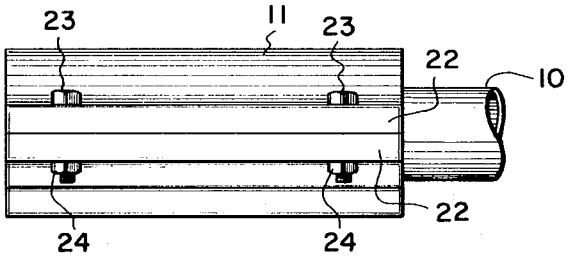
FIG. 7 is a side or elevational view of the die in place on a tube.
Figure 6:
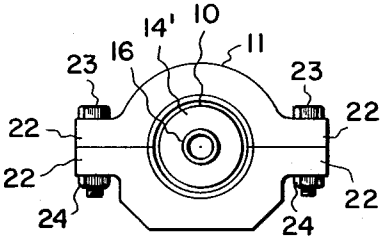
FIG. 6 is an end view of the die clamped in place on a tube.

To withstand this pressure, clamps 11 and 20 are made of relatively thick steel and are formed in two sections as shown in FIGS. 6 and 7. The top and bottom sections of steel clamp 11 or 20 are connected together by means of flanges 22 which extend outward along each side. Bolts 23 and nuts 24 are used to secure these two sections of clamps 11 or 20 together.

Figure 5:
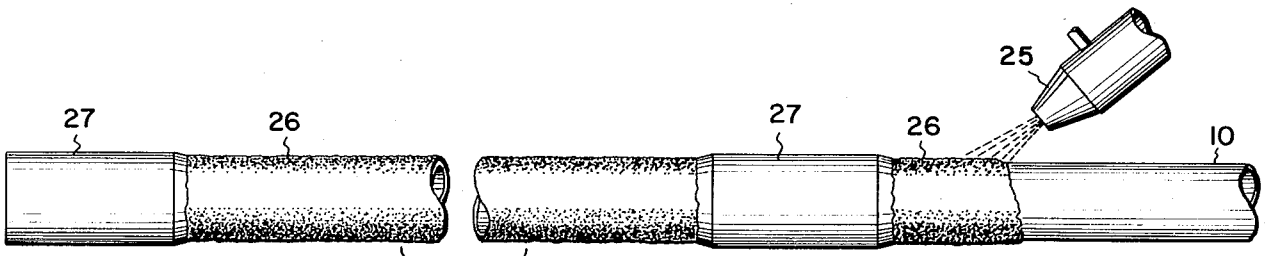
FIG. 5 shows the application of a porous boiling surface coating to the exterior of a pre-expanded tube.

After the tube 10 is expanded, hydraulic lines 16 are depressurized, clamps 11 and 20 are removed from the tube, and the mandrels 12 are withdrawn from its internal bore. Tube 10 may then undergo a flame spraying operation or other process to apply a heat transfer enhancement coating to its exterior surface between the pre-expanded sections. An example of this application is shown in FIG. 5, wherein a flame spraying nozzle 25 is used to apply a porous boiling surface 26 to tube 10, intermediate the expanded sections 27. In the preferred embodiment, porous boiling surface 26 comprises an opencell coating of oxidized metallic particles adhered to the surface of tube 10 and forming a substantial number of nucleate boiling cavities. Porous boiling surface 26 thus enhances heat transfer radially outward through tube 10 to boil a liquid, such as a refrigerant fluid surrounding tube 10, with greater efficiency. Details of the process for applying a flame sprayed porous boiling surface 26 are disclosed in U.S. Pat. No. 3,990,862, the specification of which is hereby incorporated by reference.

Figure 8:
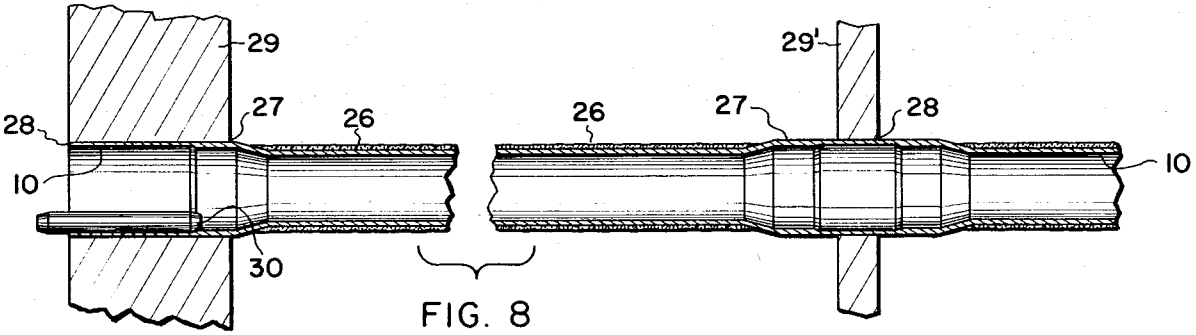
FIG. 8 is a cutaway view of the tube, showing the pre-expanded sections being mechanically roll swaged after their placement in a tube sheet/support.

It should be apparent that the pre-expanded sections 27 of tube 10 should be expanded to a diameter approximately equal to or greater than the sum of the diameter of tube 10 plus twice the thickness of the porous boiling surface 26, to permit tube 10 to be properly installed within the bores 28 of tube sheet 29 and tube support 29' as shown in FIG. 8. If the overall diameter of tube 10 and porous boiling surface 26 exceeds the diameter of bores 28, some of the porous boiling coating 26 will be abraided away as tube 10 is inserted through the bore. After installation of tube 10 in tube sheet 29 and tube support 29', a mechanical swaging tool 30 is inserted through the bore of tube 10, and the pre-expanded sections 27 are mechanically roll swaged to expand them radially outward into intimate hermetic contact with the interior surface of bores 28. The roll swaging operation is performed at each of the expanded sections 27 of tube 10. It will be apparent that minimal further radial expansion by swaging apparatus 30 is required to "set"

tube 10 within bores 28, and that the porous boiling coating 26 is therefore subjected to very little stress during this process. The pre-expansion of sections 27 thus reduces the likelihood that the porous boiling coating 26 will flake off as tube 10 is seated within tube sheets 29, and significantly reduces the possible contamination of the heat exchange system in which tubes 10 are installed, due to particles broken away from porous coating 26.

Perhaps a more important advantage of pre-expanding tube 10 is to avoid splitting it at the sections 27. The hydraulic pre-expansion process greatly reduces metal working and resulting metal fatigue which would occur if the tubes 10 were instead installed without pre-expansion and were simply roll swaged to seat them in place. Experience has shown that relatively thin walled copper tubes experience a significant failure due to work hardening induced splitting or cracking when they are roll swaged to expand them by as much as 40 to 50 mils in a single operation.

Tube 10 might also be pre-expanded by roll swaging and then annealed prior to installation in tube sheet 29 and tube support 29'. This is less preferred than the hydraulic pre-expansion since it entails an additional step and higher cost.

The method of this invention is also useful when other types of porous boiling surfaces are used, as for example a sintered metal surface such as that disclosed in U.S. Pat. No. 3,384,154. Even if no porous boiling coating 26 is applied to the exterior surface of tube 10, the method of the subject invention is also useful for minimizing the mechanical working of the pre-expanded sections 27 after tube 10 is installed within tube sheet 29 and tube support 29'. Other means for expanding pre-expanded sections 27 into intimate contact with the internal surface of bore 28 may also be used besides the roll swaging device 30 shown in FIG. 8. It will be understood that modifications such as these will be apparent to those skilled in the art within the scope of the invention, as defined in the claims which follow.

We claim:

1. A method of expanding a heat exchanger tube to which a nucleate boiling heat transfer enhancement treatment is to be applied, and seating the tube within a bore of a tube sheet or a tube support without significant degradation of the treatment, said method comprising the steps of:

a. inserting an elongate mandrel into the bore of the tube, said mandrel including an elastic bladder concentrically mounted on the mandrel and sealed at each end;

b. positioning the mandrel inside a section of the tube to be expanded;

c. positioning a die having an internal annular recess with a diameter approximately equal to or greater than the expected diameter of the tube where the nucleate boiling heat transfer enhancement treatment is to be applied, so that the recess concentrically encompasses the exterior of the tube where the mandrel has been positioned;

d. injecting a fluid under pressure through a passage in the mandrel, to expand the elastic bladder outward against the interior of the tube, causing the tube to deform and expand into the annular recess of the die;

e. reducing the pressure and removing the die and mandrel from the tube;

f. applying the nucleate boiling heat transfer enhancement treatment to the exterior of a section of the tube which is not expanded;

g. inserting the expanded section of the tube into a bore of the tube sheet or tube support; and h. mechanically roll swaging the expanded section radially outward so that the tube is in intimate contact with the inner surface of the bore.

2. The method of claim 1 wherein hydraulic fluid is used to expand the elastic bladder.

3. The method of claim 1 wherein the die is split longitudinally into two sections and the step of positioning the die comprises the steps of placing the two sections on opposite sides of the tube and clamping the tube compressively between the two sections of the die.

4. The method of claim 1 wherein the fluid is pressurized to at least 3500 PSI.

5. The method of claim 1 wherein the nucleate boiling enhancing treatment is a flame sprayed porous surface, and the heat exchanger tubes are copper or copper alloy.

6. The method of claim 1 wherein the annular recess of the die is tapered at an acute angle relative to its longitudinal axis, at each end, and the die is used to expand a section of the tube, which is intermediate the ends of the tube.

7. The method of claim 1 wherein the annular recess of the die is tapered at an acute angle relative to its longitudinal axis, on only one end, and the die is used to expand a section of the tube adjacent an end of the tube.

8. A method for expanding a heat exchanger tube to which a nucleate boiling heat transfer enhancement treatment is applied, into a bore of a tube sheet or tube support, to minimize risk of splitting the tube, or degrading the treatment, comprising the steps of:

a. pre-expanding a selected section of the tube to a diameter slightly less than the diameter of the bore in the tube sheet or tube support;

b. applying the nucleate boiling heat transfer enhancement treatment to the exterior of the tube, where it is not pre-expanded;

c. inserting the pre-expanded section of the tube within said bore; and d. mechanically expanding the pre-expanded section of the tube within said bore to seat it.

9. The method of claim 8 further comprising the step of annealing the pre-expanded section prior to its insertion into the bore.

10. The method of claim 8 wherein the tube is hydraulically pre-expanded by a. inserting an elongate elastic bladder into the bore of the tube and positioning it at the section to be expanded;

b. positioning a die, having an internal annular recess, around the section of the tube to be expanded; and c. pressurizing the elastic bladder with a fluid to a pressure sufficient to expand the bladder so that it deforms the heat exchanger tube outward into the annular recess of the die.

* * * * *